US006887049B2

(12) United States Patent
Chen

(10) Patent No.: US 6,887,049 B2
(45) **Date of Patent: *May 3, 2005**

(54) ELECTRIC FAN MOTOR ASSEMBLY

(75) Inventor: Yung Chen, Claredon Hills, IL (US)

(73) Assignee: Lakewood Engineering and Manufacturing Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/419,500

(22) Filed: Apr. 21, 2003

(65) Prior Publication Data

US 2003/0194335 A1 Oct. 16, 2003

Related U.S. Application Data

(63) Continuation of application No. 09/930,093, filed on Aug. 14, 2001, now Pat. No. 6,589,018.

(51) Int. Cl.[7] ..... F04B 35/04

(52) U.S. Cl. ..... 417/423.7; 310/68 A; 310/71; 310/89

(58) Field of Search ..... 417/423.1, 423.7, 417/423.17; 415/108, 125; 310/68 A, 71, 89, 91

(56) References Cited

U.S. PATENT DOCUMENTS

| | | | | |
|---|---|---|---|---|
| 748,771 A | | 1/1904 | Morris | |
| 1,139,158 A | | 5/1915 | Boerries | |
| 1,212,282 A | | 1/1917 | Tiffany | |
| 1,433,725 A | * | 10/1922 | Jennings | 318/779 |
| 1,751,209 A | | 3/1930 | Kucher | |
| 1,761,587 A | | 6/1930 | Ringland | |
| 1,784,624 A | | 12/1930 | Ford | |
| 1,822,263 A | | 9/1931 | Apple | |
| 2,133,985 A | * | 10/1938 | Green | 230/259 |
| 2,157,141 A | | 5/1939 | Murray | |

(Continued)

FOREIGN PATENT DOCUMENTS

| | | |
|---|---|---|
| CA | 607613 | 10/1960 |
| DE | 607551 | 1/1935 |

(Continued)

OTHER PUBLICATIONS

*Photos 1(a)—1(f) of motor; Date: before Oct. 20, 1998.
*Photos 2(a)—2(e) of motor; Date: before Oct. 20, 1998.
*Photos 3(a)—3(j) of motor; Date: before Oct. 20, 1998.
*Photos 4(a)—4(h) of Lasko motor; Date: after Oct. 20, 1998.
*Photos 5(a)—5(f) of motor; Date: before Oct. 20, 1998.
*Form Time Ind*UStries Ltd. Catalog; Date: after Oct. 20, 1998.

*Primary Examiner*—Charles G. Freay
(74) *Attorney, Agent, or Firm*—Wallenstein Wagner & Rockey Ltd.

(57) ABSTRACT

A fan assembly is disclosed. The fan assembly has a frame and a motorized blade assembly. The motorized blade assembly has an electric motor and an integrally attached bladed propeller with a central hub. The motor includes a rotor and a stator, the rotor having a rotatable output shaft extending from a front side of the motor with a bladed propeller secured to the output shaft. The motor includes a housing with a mounting area for securing an electrical control switch. The mounting area is provided by a flange portion of the rear motor wall and positioned radially outwardly relative to the output shaft, and provides mounting of the control switch with a user interface that is exposed from the fan frame. The fan assembly motor also may provide an electrical connection port for removable attachment of an electrical power cord, wherein the connection port is integral with the motor housing and is exposed from the fan frame for attachment of the cord by a user.

3 Claims, 5 Drawing Sheets

U.S. PATENT DOCUMENTS 2,195,801 A * 4/1940 Thibault ..... 172/36
2,274,489 A * 2/1942 Lofgren ..... 171/29
2,419,156 A 4/1947 Packer
2,462,204 A 2/1949 Ludwig
2,465,042 A 3/1949 Schlenker et al.
2,508,144 A 5/1950 Carville
2,512,159 A * 6/1950 Koch ..... 230/273
2,592,471 A 4/1952 Sawyer
2,610,992 A 9/1952 Johns et al.
2,611,797 A 9/1952 Beckwith et al.
2,613,240 A 10/1952 Robinson
2,650,316 A 8/1953 Johns et al.
2,716,195 A 8/1955 Anderson
2,778,958 A 1/1957 Hamm et al.
2,965,289 A 12/1960 Weibel, Jr.
3,038,093 A 6/1962 Needham et al.
3,145,910 A 8/1964 Jolly
3,196,300 A * 7/1965 Carlson ..... 310/89
3,257,572 A 6/1966 Ludemann et al.
3,271,013 A * 9/1966 Chambers et al. ..... 259/131
3,371,236 A 2/1968 Swanke
3,422,292 A 1/1969 McCoy et al.
3,446,429 A 5/1969 Suzuki et al.
3,548,226 A 12/1970 Sato
3,560,823 A 2/1971 Nystuen
3,620,644 A 11/1971 McLarty
3,638,055 A 1/1972 Zimmerman
3,717,779 A 2/1973 Hallerback
3,740,598 A 6/1973 Hallerback
3,787,014 A 1/1974 Story et al.
3,953,751 A 4/1976 Merkle et al.
3,958,140 A 5/1976 Horgan
3,967,915 A 7/1976 Litzenberg
4,017,964 A 4/1977 Schulte et al.
4,084,491 A 4/1978 Spotts et al.
4,104,551 A 8/1978 Blank et al.
4,118,644 A 10/1978 Schulte et al.
4,120,615 A 10/1978 Keem et al.
4,350,472 A 9/1982 Morimoto
4,451,749 A 5/1984 Kanayama et al.
4,473,764 A 9/1984 White
4,515,538 A 5/1985 Shih
4,603,273 A 7/1986 McDonald
4,606,000 A 8/1986 Steele et al.
4,657,483 A 4/1987 Bede
4,670,677 A * 6/1987 Snider et al. ..... 310/63
4,682,065 A 7/1987 English et al.
4,754,526 A 7/1988 Tremoulet, Jr. et al.
4,757,221 A 7/1988 Kurihashi et al.
4,759,526 A 7/1988 Crawford et al.
4,785,198 A * 11/1988 Chin-Hsiang ..... 307/154
4,849,667 A 7/1989 Morrill
4,867,647 A 9/1989 Chow
4,904,891 A 2/1990 Baker et al.
4,968,228 A 11/1990 Da Costa et al.
5,006,742 A * 4/1991 Strobl et al. ..... 310/88
5,053,666 A 10/1991 Kliman et al.
5,061,157 A 10/1991 Arakawa
5,073,735 A * 12/1991 Takagi ..... 310/71
5,079,464 A 1/1992 King et al.
5,079,467 A 1/1992 Dorman
D325,777 S * 4/1992 Cook ..... D23/382
5,126,608 A * 6/1992 Sogabe et al. ..... 310/71
5,200,658 A 4/1993 Kohno et al.
5,204,565 A * 4/1993 Sekine et al. ..... 310/71
5,239,610 A * 8/1993 Shao ..... 392/363
5,245,237 A 9/1993 Fisher et al.
5,267,842 A 12/1993 Harmsen et al.
5,370,500 A * 12/1994 Thompson ..... 416/100
5,410,201 A 4/1995 Tanaka et al.
5,430,338 A 7/1995 McMillan et al.
5,430,931 A 7/1995 Fisher et al.
5,473,211 A 12/1995 Arkkio
5,487,213 A 1/1996 Hult et al.
5,493,158 A 2/1996 Daniels
5,528,436 A 6/1996 Peter
5,554,902 A 9/1996 Kessens et al.
5,564,914 A 10/1996 Kobayashi et al.
5,567,133 A 10/1996 Kobaybashi et al.
5,627,424 A 5/1997 Steiner
5,648,694 A 7/1997 Kobayashi et al.
5,650,675 A 7/1997 Kanaya et al.
5,689,404 A 11/1997 Katsui
5,696,415 A 12/1997 Fujimoto et al.
5,714,816 A 2/1998 Jensen et al.
5,723,926 A 3/1998 Obara et al.
5,729,071 A 3/1998 Steiner
5,734,214 A 3/1998 Gilliland et al.
5,741,124 A 4/1998 Mazzucato et al.
5,760,519 A 6/1998 Fulton
5,767,596 A 6/1998 Stark et al.
5,783,879 A 7/1998 Furlani et al.
5,797,718 A 8/1998 Gerling et al.
5,880,547 A 3/1999 Shoykhet
5,914,550 A 6/1999 Periyathamby et al.
5,932,942 A 8/1999 Patyk et al.
5,936,322 A 8/1999 Yamaguchi et al.
5,939,807 A 8/1999 Patyk et al.
5,945,761 A 8/1999 Sakuma
5,951,267 A 9/1999 Piercey et al.
5,982,057 A 11/1999 Imada et al.
6,002,185 A 12/1999 Nakao et al.
6,005,314 A * 12/1999 Fisher et al. ..... 310/68 C
RE36,545 E 2/2000 Steiner
6,020,668 A 2/2000 Rubinchik
6,037,688 A 3/2000 Gilliland et al.
6,050,786 A 4/2000 Lin
6,104,114 A 8/2000 Takeda et al.
6,109,887 A 8/2000 Takura et al.
6,126,415 A 10/2000 Lasko
6,144,137 A 11/2000 Engelbert
6,150,743 A 11/2000 Van Dine et al.
6,200,155 B1 * 3/2001 Chudkosky et al. ..... 439/371
6,203,293 B1 3/2001 Yamamoto et al.
6,227,822 B1 5/2001 Chen
6,589,018 B2 * 7/2003 Chen ..... 417/14

FOREIGN PATENT DOCUMENTS

DE 357081 11/1961
FR 2 661 055 A1 10/1991
GB 197806 6/1978
GB 1 515 197 6/1978
GB 2 126 017 A 3/1984
JP 52-43915 6/1975
JP 50-119788 11/1975
JP 53-98371 8/1978
JP 55-68839 A 5/1980
JP 57-3544 A 1/1982
JP 57-198397 A 12/1982
JP 58-112430 A 7/1983
JP 58-172953 A 10/1983
JP 59-76144 A 5/1984
JP 62-173946 A 7/1987
JP 63-206141 A 8/1988
JP 4-69025 3/1992
JP 4-297827 10/1992
JP 6-38418 2/1994
RU 1744761 A1 6/1992
SU 394896 8/1973
SU 509945 4/1976
SU 756-544 12/1977

| | | |
|---|---|---|
| SU | 771-806 | 12/1978 |
| SU | 780-107 | 11/1980 |
| SU | 892-583 | 12/1981 |
| SU | 1436-207 A | 11/1988 |
| SU | 1658297 A1 | 6/1991 |
| WO | WO 91/01584 A1 | 2/1991 |

* cited by examiner

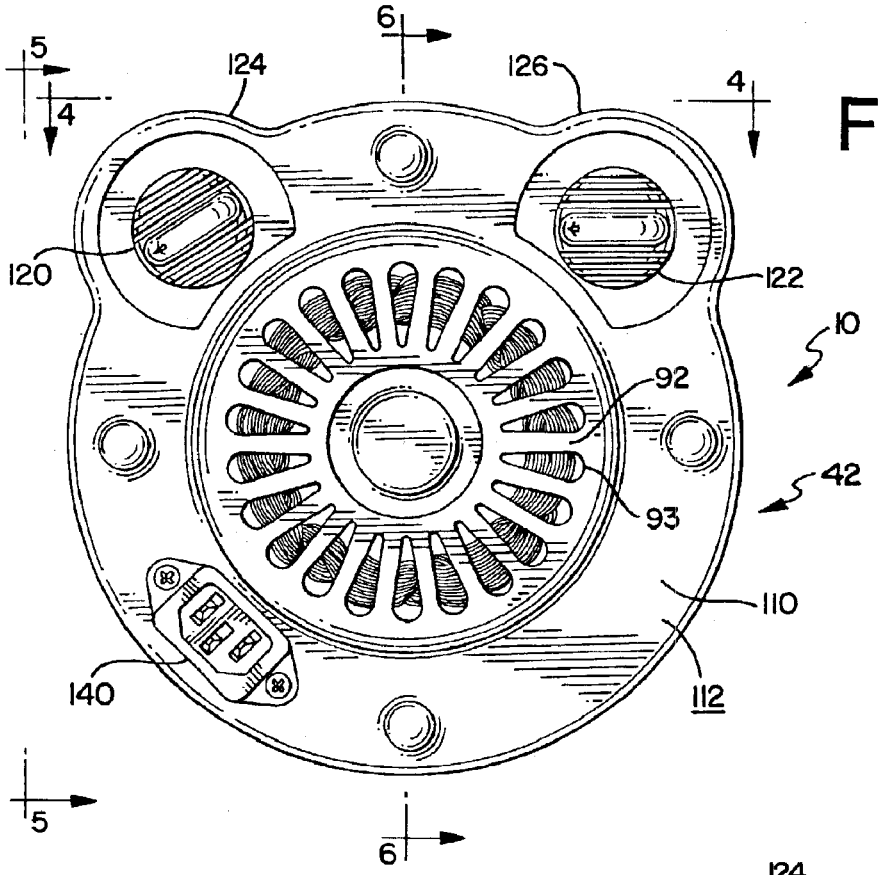
FIG. 2
FIG. 3
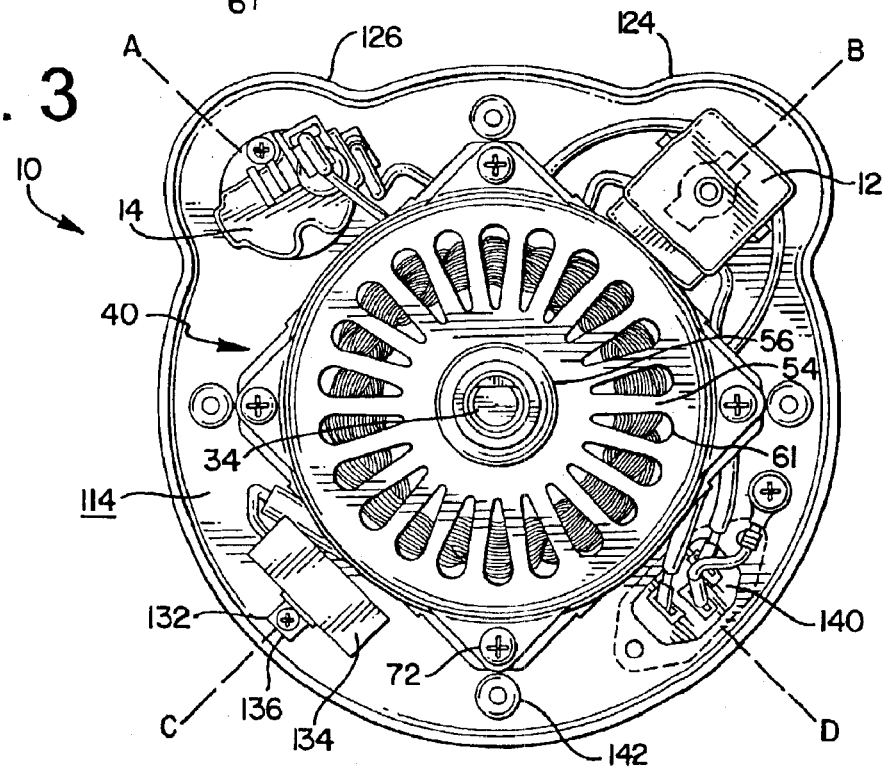

ELECTRIC FAN MOTOR ASSEMBLY

RELATED APPLICATION

This Application is a continuation of U.S. patent application Ser. No. 09/930,093, filed on Aug. 14, 2001 now U.S. Pat. No. 6,589,018, which is incorporated herein by reference and made a part hereof, and upon which a claim of priority is based.

TECHNICAL FIELD

The present invention relates to an electric motor for a fan assembly. More particularly, the present invention relates to an electric motor for use in a fan assembly having a mounting area of the motor housing providing mounting of a control switch exposed from the fan housing, and a electrical connection port for attachment of a power cord from outside the fan housing.

BACKGROUND OF THE INVENTION

Household fan devices generally include several common components. The components typically consist of a frame or housing that includes housing walls and a front and rear grill. Such devices, whether fans, heaters, air purifiers or the like, also typically include a bladed propeller assembly with an electric motor connected to a control switch that is secured to a portion of the housing of the device. The switch is then connected to the motor by a switch cord set having a portion passing into an opening of the motor housing. Each component may be manufactured at a separate facility. The components are shipped to an assembly facility where they are assembled to produce the household device.

The assembly process comprises the steps of attaching the bladed propeller assembly to an output shaft of the motor, mounting the motor within the frame, and connecting lead wires from the electric motor to the output controls. This assembly process is time consuming and is thereby costly. Thus, it would be desirable to reduce the assembly time and complexity of this process.

The present invention provides a way of reducing or eliminating assembly steps by providing an electric motor with the control switches electrically connected to the motor prior to the fan-device assembly process. The present invention solves several obstacles to designing such a device, including concerns regarding the needed surface area to which the control switches may be mounted, prevention of damage to the switches during shipping, and having the switches exposed for manipulation by the user. Further, the present invention also provides an electrical connection port for removable attachment of a power cord directly to the motor housing, thereby further reducing the cost and complexity of assembly and providing non-use storage efficiency for the user. The present invention is provided to overcome these and other drawbacks and obstacles.

SUMMARY OF THE INVENTION

It is an object of the present invention to provide a fan assembly comprising a frame and a motorized blade assembly. The frame includes a grill. The motorized blade assembly is mounted to the frame.

The motorized blade assembly comprises an electric motor and an integrally attached bladed propeller with a central hub. The electric motor has a rotor and a stator. The rotor includes a rotatable output shaft extending from a front side of the motor. The bladed propeller is secured to the output shaft. The stator includes copper windings and a core of stacked laminations.

The electric motor further includes a housing. The housing includes front and rear spaced apart end walls, and a mounting portion. The front end wall has an opening through which the output shaft passes. The flange portion extends radially outwardly relative to the output shaft and is located between the front and rear end walls.

The mounting portion os provided as a flange portion that includes a rheostat and/or similar power switch device for controlling an output of the motor. The power switch has a user interface portion that is exposed from the fan housing. Also, mounting of the switch to the motor is in a recessed fashion relative to at least a portion of the rear wall. The assembly also provides direct attachment of a removable power cord at a power source port. The port is integrally formed in, or attached to, the motor housing and is adapted to be exposed from the fan frame and/or grill for the user to attache the power cord from outside the assembly.

Other features and advantages of the invention will be apparent from the following specification taken in conjunction with the following drawings.

BRIEF DESCRIPTION OF THE DRAWINGS

FIG. 2 is a plan view of the rear of an electric motor of the present invention;

FIG. 3 is a plan view of the front of an electric motor of the present invention;

DETAILED DESCRIPTION

Figure 1:
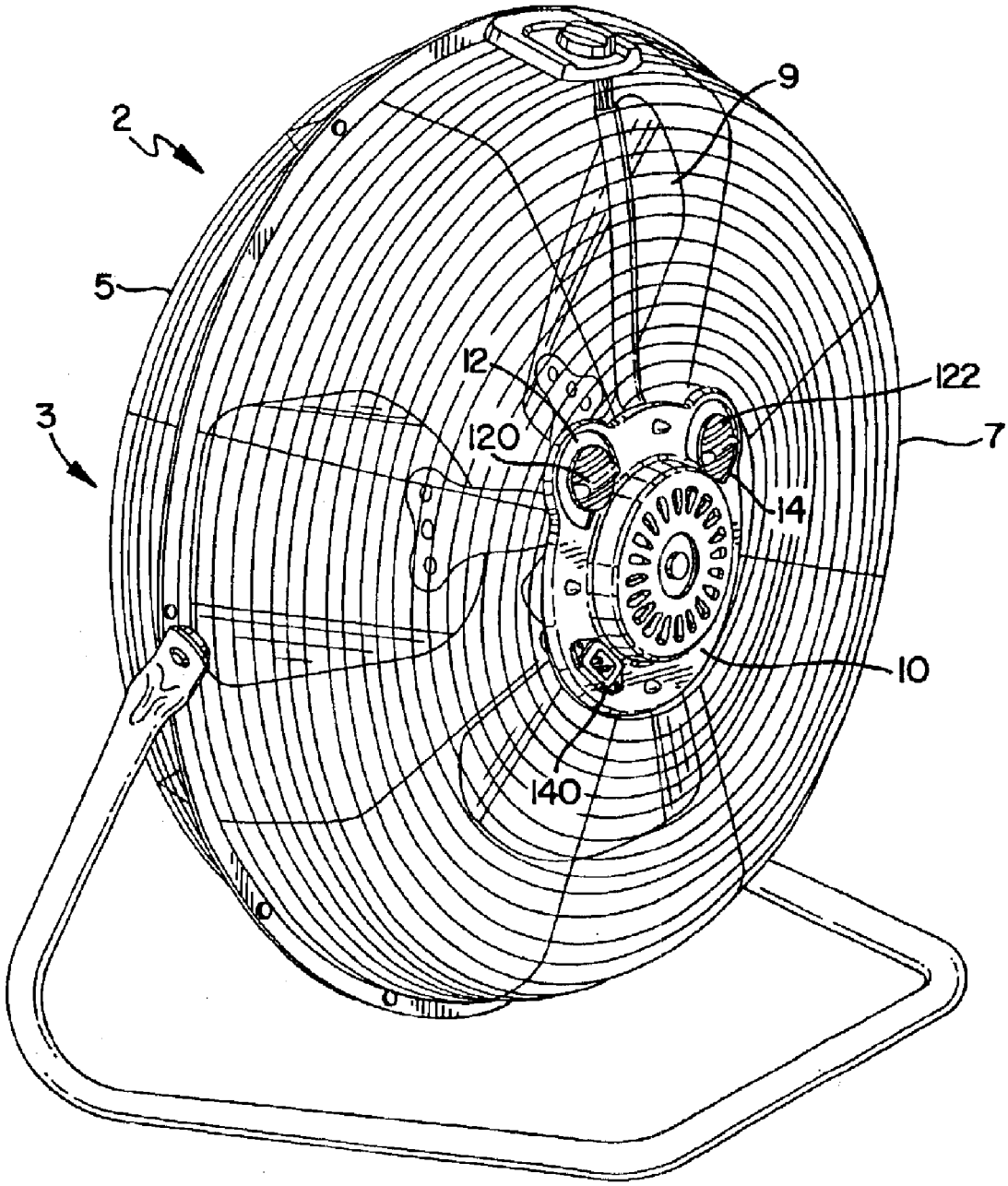
FIG. 1 is a perspective view of the rear of a fan assembly of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 4:
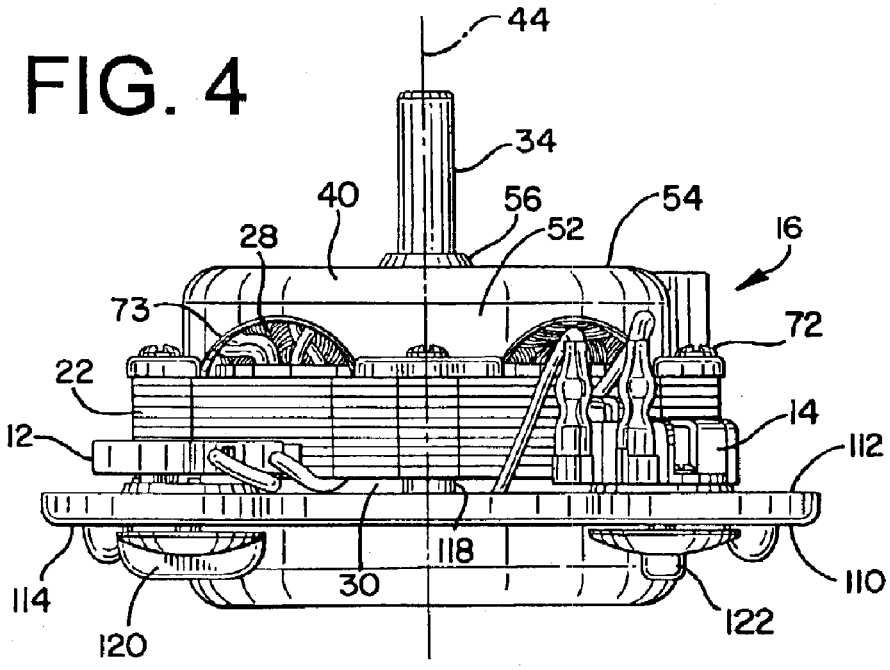
FIG. 4 is a view taken along 4—4 of FIG. 2 of an electric motor of the present invention.
Figure 5:
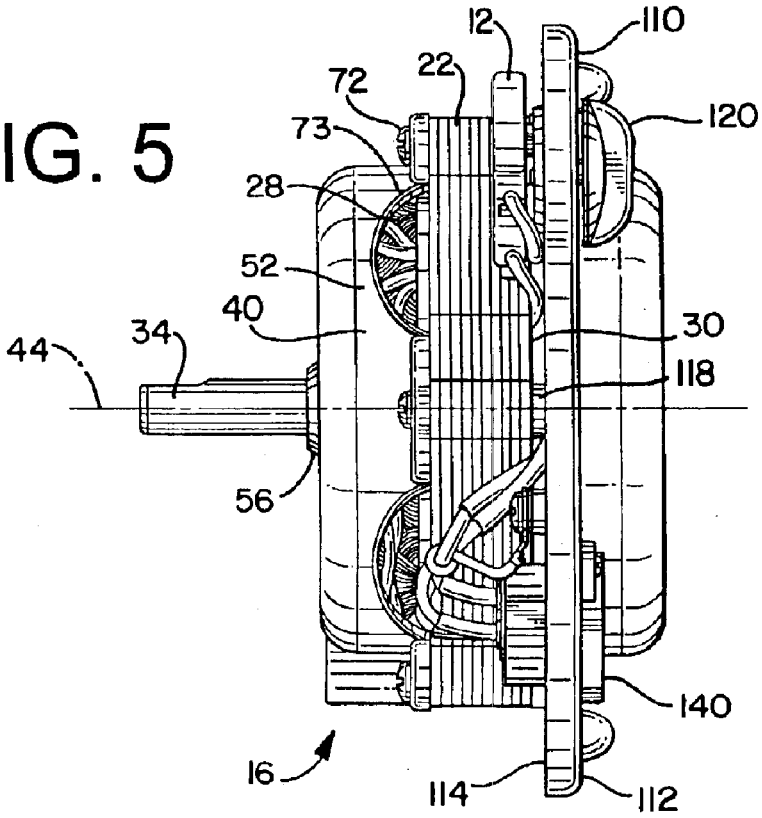
FIG. 5 is a view taken along 5—5 of FIG. 2 of an electric motor of the present invention.
Figure 6:
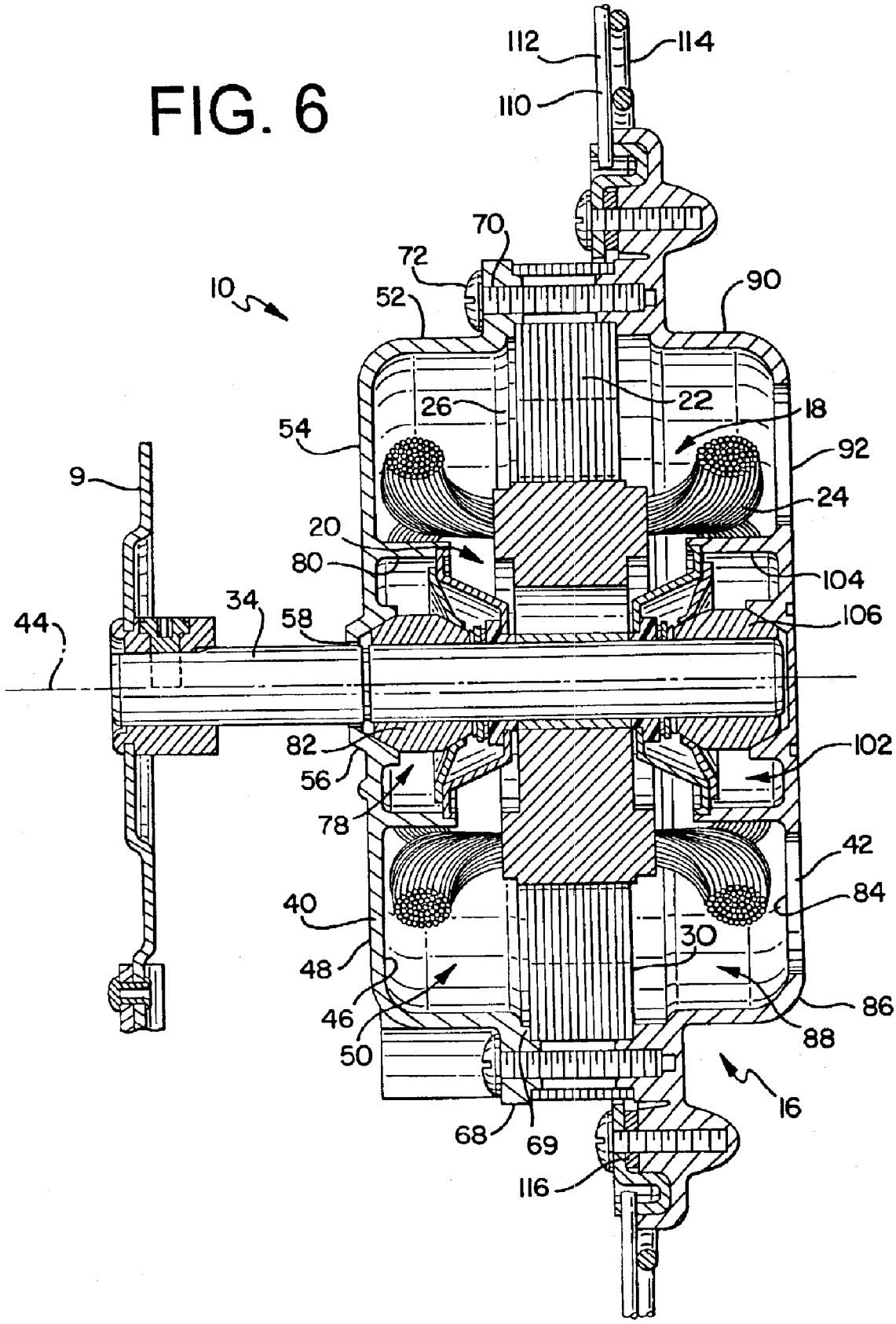
FIG. 6 is a cut away side view taken along 6—6 of FIG. 2.

FIG. 1 is a perspective view of the rear of a fan assembly 2. A fan assembly frame 3 comprises a front grill 5 attached at an edge portion to an edge portion of a rear grill 7. A bladed propeller assembly 9 and a motor 10 are housed within the frame 3. The fan assembly 2 also includes output controls 12, 14 for regulating the output of the motor 10, control of a thermostat device, and/or a heating or cooling element. In the example described in the figures, for simplicity, a portable fan device is used. However, the inventive features of this patent may be included in other household devices requiring a blower motor. Examples include heaters, humidifiers, de-humidifiers, air coolers and air conditioners, air purifiers, and the like. Further, although the device shown uses a common bladed propeller for the fan, the blower or other device may use alternative arrangements, such as a cage-type propeller. The electric motor 10 of this invention is generally used to drive an air circulating assembly of a household device, such as the fan assembly 2 of the Figures. Specifically, referring to FIGS. 2–6, the electric motor 10 of the patent Figures is a four-pole permanent split capacitor (PSC) electric motor 10. Such a PSC motor is described in U.S. Pat. No. 6,227,822, which is incorporated by reference herein. The motor 10 includes a motor housing or casing 16 for shielding the electric motor 10. The electric motor 10 includes a stator 18 and a rotor 20. The stator 18 comprises a core of stacked laminations 22 around which copper wires 24 are wound. As shown in FIGS. 4–6, a first outermost lamination 26 in the stack defines a first supporting surface or front surface, and a second outermost lamination 30 defines a second supporting surface or rear surface. An output shaft 34 is connected to the rotor 20.

Referring to FIG. 4, the motor's windings 28 have first and second parts. The first parts extend outwardly from the first and second outermost laminations 26, 28. The second parts pass through the interior of the core 22. The first parts bend as they emerge from the core of stacked laminations 22. The bend of the first and second parts forms a slot exit angle between the first parts and the first and second supporting surfaces 26 and 30, defined by the angle between the inner (closest to rotor) portion of the respective supporting surfaces 26 and 30, and the inner surface of first parts as it leaves the slots. The dimensions of the outer circumference and inner diameter of the windings 24 may be increased such that the height of the windings 24 may be reduced and thereby compact the motor thickness. This is fully disclosed in the referenced patent identified above.

The motor housing 16 comprises generally dome-shaped first (front) and second (rear) casings 40, 42. The first casing 40 is centered about a longitudinal axis 44 and has a first interior surface 46 and a first exterior surface 48. The first interior surface 46 defines a first chamber 50. The first exterior surface 48 includes a circumferential side wall 52 connected to a first (front) vented end wall 54. The first vented end wall 54 has a central area 56 extending outwardly away from the stacked laminations 22.

The central area 56 defines an opening 58 through which a proximal end 59 of the motor's output shaft 34 passes. The central area 56 is adapted to receive a female connector located on an inner surface of a central hub of the fan blade assembly 9 (see FIG. 6). The female connector is press fit around the output shaft 34.

The casings 40 and 42 can be formed of aluminum and die-cast, due to their narrower diameter than the casings of typical shaded pole motors. The die-casting of casings 40 and 42 enables production with a high degree of accuracy and consistency. Alternatively, the casings 40 and 42 can be formed of plastic or the combination of metal and plastic components. The first vented end wall 54 also includes a plurality of vents 61 (see FIG. 3). The vents 61 shown are tear-shaped and are positioned between the central area 56 and the first circumferential side wall 52. The vents 61 allow air to circulate through the motor housing 12, and the electric motor's 10 operating temperature is lowered by air circulation and draw of air by fan operation.

At one end, the first circumferential side wall 52 is connected to a first lip portion 68. The first lip portion 68 engages the first supporting portion 26 of the stacked laminations 22. The first lip portion 68 has a plurality of pads or lands 69 which engage the first supporting surface 28. The first lip portion 68 also includes a plurality of bolt holes 70 adapted for receiving bolts, fasteners 72, or other connection means. The bolts 72 are long enough to pass from the first casing 40 through the stacked laminations 22 to the second casing 40. The first lip portion 68 further includes ventilation slots 73. The ventilation slots 73 are located between the first supporting portion 26 and the first vented end wall 54. The ventilation slots 73 are provided for additional motor cooling. This arrangement of a short side wall 52 between the lip 68 and the front end wall 54 may be modified to provide more substantial amount of side wall 52. In the embodiment shown in the Figures, the mounting of a switch and/or power inlet is integral with the rear wall. However, the invention also contemplates an alternative arrangement of placing the switch and/or power attachment port elsewhere on the motor housing, such as an expanded sidewall area 52, or a similar sidewall 90 adjacent the rear wall 92, or placement directly in the front wall 54.

A first hub 78 is positioned within the first chamber 50 on the first interior surface 46 of the first casing 40. The first hub 78 stabilizes the output shaft 34 within the motor housing 16. The first hub 78 is centered about the longitudinal axis 44. The first hub 78 has a cylindrical side wall 80 that extends from the first interior surface 46 downwardly toward the stacked laminations 22. A sleeve 82 is fitted within the first hub 78 to further stabilize the output shaft 30.

The second (rear) casing 42 also has a second interior surface 84 and a second exterior surface 86. The second interior surface 84 defines a second chamber 88. The second exterior surface 86 comprises a second circumferential side wall 90 connected to a second vented end wall 92. The second (rear) vented end wall 92 is similar to the first vented end wall 54. The second vented end wall 92 also has a plurality of vents 93. The vents 93 are tear-shaped. The vents 93 are positioned between a central portion and the second circumferential side wall 90. The vents 93 aid in reducing the operating temperature of the electric motor 10.

A second hub 102 is positioned within the second chamber 88 on the second interior surface 84 of the second casing 42. The second hub 102 stabilizes the output shaft 34 within the motor housing 16. The second hub 102 is also centered about the longitudinal axis 44. The second hub 102 has a second cylindrical side wall 104 that extends from the second interior surface 84 upwardly toward the stacked laminations 22. A sleeve 106 is fitted within the second hub 102 to further stabilize the output shaft 34.

A mounting area is provided on the motor casing, shown in the Figures as a flange body 110 extending from the rear casing 42 radially outward relative a central axis 44 of the output shaft, and preferably extending adjacent the second circumferential side wall 90. Accordingly, the flange 110 is preferably spaced a distance from the second vented end wall 92 in a direction towards the front casing 40. The flange 110 has an upper surface 112 and a lower surface 114. In accordance with the present invention, the mounting body, or flange 110 alternatively provides adapted mountings. In one significant aspect of the invention, the mounting area 110 is adapted to provide direct attachment of at least one electric control switch 12, 14. This aspect of the invention provides a mounting area 10 that is adapted to provide mounting of the switch 12, 14 in a manner that allows exposure of the user interface portion 112, 120 of the switch 12, 14 when the motor is mounted in the fan device housing 3. In the preferred embodiment, a portion of the rear casing of the motor is exposed in the rear of the fan housing 3, and forms a region of the wall defining the rear wall 5 of the fan 2.

In accordance with other advantages of the invention, the flange 110 may also provide means for securing the rear motor casing 42 to the other portions of the motor 10. In the embodiment shown herein, the means for mounting is provided by use of a plurality of threaded bolt holes 116 adapted to receive the bolts 72 used to join the first and second casings 40, 42 with the core of stacked laminations 22. The lower surface 114 has a plurality of pads or lands 118 which engage the second supporting surface 32. The pads or lands 69, 118 cooperate to sandwich the stacked laminations 22 between the first and second casings 40, 42 in such a way that the two outermost laminations 26, 30 are not positioned within the first and second chambers 50, 88. Additionally, a space is created between the second supporting surface 30 and the upper surface 112 such that wires can pass through the space and be connected to the motor 10.

The electrical controls 12, 14 preferably include motor output controls, and are secured on the lower surface 114 of the flange 110. In the embodiment illustrated, a rheostat 12 for controlling the rotational speed of the output shaft 34 is provided as well as a thermostat 14 for controlling the temperature of a heating and/or cooling element. The output controls 12, 14 are mounted to the lower surface 114 with fasteners, such as screws, bolts, or the like.

A portion of each output control 12, 14 passes through an aperture in the flange 110 to the upper surface 112. Electrical control user interface, such as control knobs 120, 122 shown in the Figures, are fixed to the output controls 12, 14 at the upper surface 112 of the flange 110. The spacing of the flange 110 from the second vented end wall 92 is great enough where the control knobs 120, 122 are located between a plane defined by the second vented end wall 92 and the flange 110 (see FIGS. 4 and 5). This arrangement allows the motor 10 to be shipped while resting on the second vented end wall 92 without damaging the control knobs 120, 122. Also, the control knobs 120, 122 are typically produced from polymeric materials; thus, the additional spacing from the core 22 may prevent heat damage from occurring to the control knobs 120, 122.

In an alternative embodiment, the user interface 12, 14 may be provided by other common means and apparatus, such as touch controls, buttons, dials, toggle switches and slide mechanisms. Regardless, one significant feature of the present invention is providing manipulation of the user interface of the electrical controls 12, 14 by the user, with the motor output controls being secured directly to, or integrally attached to, the motor casing. This reduces the parts needed for more distant connection of the switches, and provides a design with pre-assembled features in the motor for ease of final fan device assembly.

Figure 7:
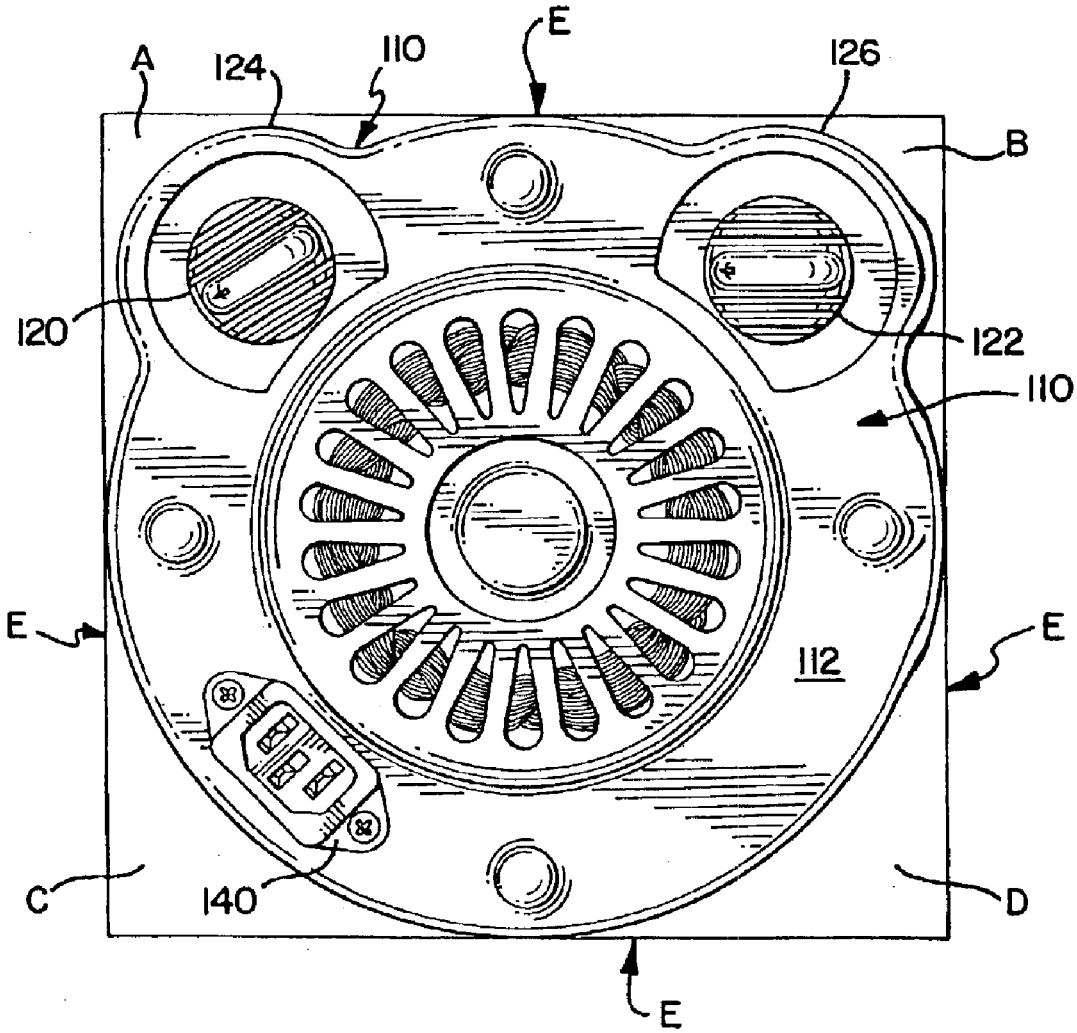
FIG. 7 is a view similar to FIG. 2, with an outer rectangular border shown.

The output controls 12, 14 are preferably located approximately at the 10 o'clock and 2 o'clock positions of the flange 110. Expanded mounting areas 124, 126 along the peripheral edge of the flange 110 are provided to accommodate the user interface 120, 122 and control scales associated with such interfaces (such as dials) may be associated with the motor casing or the fan assembly rear wall and/or grill. In the embodiment illustrated, the expanded mounting areas 124, 126 are annular extensions; however, the mounting areas may take any shape without departing from the spirit of the invention. The mounting areas 124, 126 do not extend beyond longitudinal extent (the 3 o'clock and 9 o'clock positions as illustrated) and latitudinal extent (the 12 o'clock position as illustrated) of the peripheral edge of the flange 110 (see FIGS. 2 and 3). In other words, any extended body portions relative to the rear casing 42 are preferably located at directly opposed or adjacent quadrants A, B, C, D (FIGS. 3, 7) of the motor housing. In the embodiment shown herein, the two extended mounting bodies for securement of the switches are in the adjacent quadrants of position A and position B, at approximately 90 degrees relative to one another with the central rotational axis being the axial point. This arrangement is adapted to provide the motor casing features residing within a rectangular bordered area E (Figure &), thereby allowing the electric motor 10 to be packed in a substantially square space (box or packaging compartment) during shipping to save space. Therefore, although certain advantages of the present invention may be achieved by providing extending mounting bodies that are on opposite sides of the motor housing (i.e., not in adjacent or directly opposed quadrants A–D), the resulting motor will likely have larger packaging requirements to compensate for the extended body portions residing outside the rectangular border E.

The lower surface 114 also includes a receiver which is geometrically adapted to receive a cooperatively dimensioned edge of a mounting plate 132 attached to a capacitor 134. The receiver and edge are preferably flat, such that the capacitor 134 can be mounted using a single fastener 136 such as a bolt, screw, or the like, the cooperating surfaces preventing twisting of the capacitor 134. Other cooperating geometries may optionally be employed. Capacitor 134 is mounted such that it is below the first vented end wall 54 along the side of the motor 10 and clear of any moving parts of the bladed propeller assembly 9.

An electrical input port or socket 140 is also located on the motor housing. In the preferred embodiment, the electrical port 140 is positioned directly in a flange body 110 extending as an integral extension of the rear casing 42 end wall. However, the electrical port 140 may alternatively be secured to the motor housing by an integrally attached body portion serving as the flange 110. The input socket is electrically connected to the motor 10 and adapted to receive an electric power cord by the user. The electrical power cord (not shown) has a mating and appropriate connector to be attached to the port 140 from outside the fan housing. In the preferred embodiment, the portion of the motor casing having the electrical port is exposed form the device housing (such as an opening in the housing wall or grill structure) for the user to attach the cord.

The lower surface 114 of the flange 110 further comprises mounting apertures 142 for attaching the motor 10 to mounting surfaces of the fan (See FIG. 3). The mounting apertures 142 are located radially outwardly of the stack of laminations 22. Each mounting aperture is adapted for receiving a fastening device. The fastening device attaches the motor 10 to a support bracket within the fan frame 3.

The motor 10 of the present invention is useful for reducing shipping damage and costs. Shipping damage is reduced because the control knobs (or other user interface mechanics) 120, 122 are located between the plane defined by the second vented end wall 92 and flange 110. Thus, in the embodiment with control knobs 120, 122, the knobs are not subject to abuse in shipping, and are thereby protected from damaged when the motor 10 is packaged with the second vented end wall 92 providing a resting surface. Shipping costs are reduced by eliminating extra protective packaging, and providing a motor 10 that can be packed in a substantially flat and square compartment, thus saving packaging space.

The motor 10 of the present invention is also useful for reducing the steps associated with assembling the fan. Because the electrical controls are already mounted on the motor 10, the step of connecting the electrical motor to the output controls fixed to the fan frame is eliminated from the assembly process. The motor 10 is simply fastened to the frame of the fan, and there is no need to connect long lead wires to an external control panel. Also, because the need for long lead wires is eliminated, the special designs needed to conceal or protect the lead wires from the rotating bladed propeller are also eliminated. This further results in a reduced likelihood of the lead wires becoming loose and dangling into the path of the bladed propeller.

A method for producing a household appliance with a fan motor is also disclosed. The method includes the steps of providing an appliance housing having a motor with control switches mounted directly thereto, and securing the motor within the appliance housing. The method preferably also including the step of providing an electrical power source connection on the motor housing and mounting the motor in a manner adapted to provide an exposed area for the port to receive an electrical cord by a user.

While specific embodiments have been illustrated and described, numerous modifications are possible without departing from the spirit of the invention, and the scope of protection is only limited by the scope of the accompanying claims.

What is claimed is:

1. An electric motor for incorporation into a fan assembly, the motor comprising:

a rotor including a rotatable output shaft;

a stator including a core of stacked laminations and windings, the laminations defining a supporting portion;

a housing covering at least a portion of the rotor and stator, the housing engaging the supporting portion and having an electrical control switch attached directly thereto for controlling the operation of the motor the control switch having a user interface portion adapted to be exposed from the fan assembly in a direction generally parallel to the output shaft and for manipulation by a user; and an electrical input port directly attached to the housing for receiving an electrical cord for connecting a source of electrical power to the motor.

2. An electric fan assembly comprising:

a frame;

an electric motor having a rotor including a rotatable output shaft, a stator including a core of stacked laminations defining a supporting portion and a housing engaging the supporting portion with a control switch directly attached to the housing, the control switch having a user interface portion protruding outwardly from the frame in a direction generally parallel with the output shaft; and an electrical input port directly attached to the housing, the port protruding outwardly from the frame for operably connecting a source of electrical power to the motor.

3. An electric motor comprising:

a housing engaging a supporting portion defined by a core of stacked laminations and rotatably supporting a rotor including a rotatable output shaft;

a control switch directly attached to the housing and having a user interface portion extending away from the housing and oriented generally parallel to the rotatable output shaft; and an electrical input port directly attached to the housing, the port protruding outwardly from the frame for releasably connecting a source of electrical power to the motor.

* * * * *